United States Patent [19]

Franksen

[11] Patent Number: 4,623,769

[45] Date of Patent: Nov. 18, 1986

[54] CONTINUOUS-CURRENT SWITCH FOR SHORTING AT LEAST ONE SUPERCONDUCTING MAGNET WINDING

[75] Inventor: Holger Franksen, Erlangen, Fed. Rep. of Germany

[73] Assignee: Siemens Aktiengesellschaft, Munich, Fed. Rep. of Germany

[21] Appl. No.: 543,253

[22] Filed: Oct. 19, 1983

[30] Foreign Application Priority Data

Oct. 28, 1982 [DE] Fed. Rep. of Germany ..... 3240019

[51] Int. Cl.[4] ..... H01H 1/30; H01H 1/50

[52] U.S. Cl. ..... 200/250; 200/262; 200/289; 200/83 N

[58] Field of Search ..... 200/262, 289, 251, 250, 200/245, 83 N

[56] References Cited

U.S. PATENT DOCUMENTS

| | | | |
|---|---|---|---|
| 3,539,750 | 11/1970 | Holm | 200/251 |
| 4,021,633 | 5/1977 | Kuwabara et al. | 200/262 |
| 4,024,363 | 5/1977 | Marsing et al. | 200/289 |
| 4,239,979 | 12/1980 | Chapuis et al. | 200/83 N |
| 4,385,215 | 5/1983 | Lemberg | 200/5 A |

FOREIGN PATENT DOCUMENTS

| | | | |
|---|---|---|---|
| 2102705 | 2/1983 | United Kingdom | 200/267 |

*Primary Examiner*—Stephen Marcus
*Assistant Examiner*—Renee S. Kidorf
*Attorney, Agent, or Firm*—Kenyon & Kenyon

[57] ABSTRACT

A continuous-current switch for shorting at least one superconducting magnet winding is provided with at least two contacts, each of which comprises several superconducting conductor sections which are arranged parallel to one another. The superconducting conductor sections are connected to support elements and are cooled by a cryogenic coolant. An actuating device is provided for joining the superconducting conductor sections together with a predetermined contact pressure. In order to ensure contact resistances are as low as possible for large superconducting magnets, the invention provides that the superconducting sections are arranged at the surfaces of the contacts facing each other in at least substantially parallel planes whereby the superconducting conductor sections of the first contact cross the superconducting conductor sections of the other contact. Moreover, the conductor sections of the second contact are provided with a resilient support arrangement which may be in the form of springs or a pneumatic or hydraulic spring bellows.

9 Claims, 2 Drawing Figures

CONTINUOUS-CURRENT SWITCH FOR SHORTING AT LEAST ONE SUPERCONDUCTING MAGNET WINDING

BACKGROUND OF THE INVENTION

This invention relates generally to continuous-current switches for shorting superconducting magnet windings, and more particularly, to a continuous-current switch having at least two contacts each having several superconducting conductor sections which are arranged parallel to one another, connected to a support element, and are cooled with a cryogenic coolant; the contacts being provided with an actuating device for joining the superconducting conductor sections with a predetermined contact pressure.

A continuous-current (persistent) switch of the type discussed herein is described in U.S. Pat. No. 4,021,633. It has been learned that once a strong field has been built up in a superconducting magnet winding, no additional electrical energy is required to be supplied from the outside to maintain the field of the coil. The only power then required is that which is needed to operate the refrigeration devices which maintain the superconducting state of the winding. In order to store the electrical energy conducted into the magnet winding, the magnet winding can be shorted at its ends by means of a continuous-current switch having a resistance which is as low as possible. The current then flows almost unattenuated in the shorted circuit, and the current supply required for exciting the magnet winding can therefore be interrupted.

The known continuous-current switch contains two contacts, each having a support element of normal-conducting material as the matrix, in which mutually parallel superconducting conductor sections are embedded. A mechanical actuating device required for opening and closing the switch is designed so that the superconducting conductor sections of the two contacts, as well as their normal-conducting portions, can be joined together.

The contact surfaces are maintained at the operating temperature of the superconducting conductor sections indirectly by a cryogenic coolant. Such contact surfaces are arranged in a vacuum chamber so that contamination of the surfaces can be eliminated.

In such a continuous-current switch, the surface of one contact is curved, while the other contact may have, for example, a plane or a concave surface. In order to ensure a low contact resistance between the superconducting conductor sections of the two contacts, a relatively large contact pressure is required in addition to accurate guidance of the contacts. The foregoing notwithstanding, it cannot be assured that all corresponding superconducting conductor sections of the two contacts are joined together with approximately the same contact pressure, and therefore produce approximately equal contact resistances. Instead, it must be assumed that individual conducting conductor sections touch one another only with relatively low contact pressure and thereby lead to correspondingly high contact resistances. In the known continuous-current switch, reproducible resistances on the order of $10^{-9}$ ohm, or less, cannot be assured. Such resistances are required particularly for large superconducting magnets such as are required, for example, for devices for nuclear fusion or for nuclear spin tomography(nuclear magnetic resonance tomography).

It is, therefore, an object of this invention to improve known continuous-current switches such that contact resistances of the order mentioned herein can be achieved in a simple manner.

SUMMARY OF THE INVENTION

The foregoing and other objects are achieved by this invention which provides that the superconducting conductor sections are arranged at the surfaces of the contacts facing one another, and lying in at least approximately parallel planes such that the conductor sections of the first contact cross the conductor sections of the other contact. Moreover, the conductor sections of the first contact are attached permanently to the surface of the corresponding support element, while each conductor section of the other contact is held by means of a resilient support device at least over each crossing.

In one embodiment of the continuous-current switch, approximately equal contact pressure of a value required for good contacts can be achieved without difficulty with a relatively small total force as a result of their being provided a multiplicity of defined small contact areas. Thus, the connecting of many contact points in parallel has an advantageous effect on the total resistance of the switch, and a matching of the switch to the current-carrying capacity of the entire conductor by utilization of a corresponding number of contact points can be achieved.

In a specific illustrative embodiment of the invention, the resilient support device contains a guiding and holding linkage which is connected to a support element of the contact. A spring is clamped between the corresponding conductor sections and the support element. Alternatively, the resilient support device contains a spring bellows connected to the support element of the other contact, and a diaphragm to which the superconductor sections are fastened. The interior of the spring bellows and the diaphragm can be pressurized by means of a gaseous or liquid coolant. In one illustrative embodiment, the diaphragm is formed of an alloy steel. In addition, the coolant for cooling the superconducting magnet winding is provided as the pressure medium.

BRIEF DESCRIPTION OF THE DRAWINGS

Comprehension of the invention is facilitated by reading the following detailed description in conjunction with the annexed drawings, in which.

DETAILED DESCRIPTION

Figure 1:
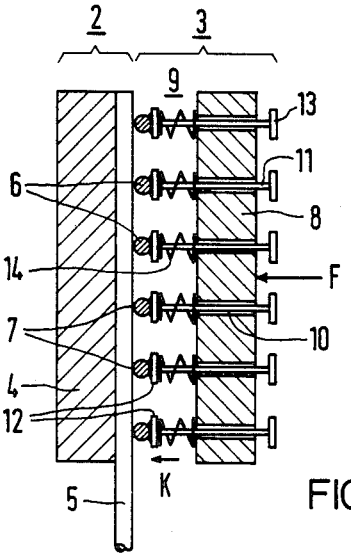
FIG. 1 is a cross-sectional representation of an embodiment of the invention which utilizes springs as resilient element.

FIG. 1 is a cross-sectional representation of an embodiment of the invention having two contacts 2 and 3 which can move with respect to one another and joined together by means of an actuating device (not shown). First contact 2 is arranged to be stationary while movable contact 3 can be pressed against the stationary contact by means of the actuating device which operates with a force F represented by an arrow.

The contacts 2 and 3 are connected respectively to the ends of the conductors of at least one superconducting magnet winding (not shown) in an electrically conducting manner. The magnet windings may, for example, be the windings of a magnet system for generating the magnetic base field of a system for nuclear spin tomography, or the winding of a magnet of a nuclear fusion plant.

Stationary contact 2, for example, contains a plane contact plate 4 on its surface which faces the movable contact 3. A multiplicity of mutually parallel superconducting conductor sections 5 are mechanically firmly engaged therewith. For example, at least five superconducting conductor sections 5 are soldered to contact plate 4 which serves as the support element. Contact plate 4 consists of an electrically highly conductive material which is normal-conducting at the operating temperature of the superconducting conductor section 5, for example, of copper or aluminum. The superconducting conductor sections which have, for example, a round or rectangular cross section, may be of the so-called "large-current superconductors." Such conductor sections may or may not be stabilized. It is preferred that the superconducting conductor parts of these conductor sections lie at least on the surface side facing movable contact 3.

Movable contact 3 also contains a multiplicity of individual mutually parallel-oriented superconducting conductor sections 6. These conductor sections are arranged relative to the conductor sections 5 of stationary contact 2 to be transverse such that a multiplicity of crossings or contact points is produced when conductor sections 5 and 6 of contacts 2 and 3, respectively, are joined. In accordance with the invention, sections 6 are not fastened rigidly to a movable contact plate 8 which is connected to the actuating device. Instead, conductor sections 6 are supported resiliently against their contact plate 8. Each conductor 6 is fastened to movable contact plate 8 in the regions of conductor crossings 7 via a support device 9 which serves to guide and hold the conductor sections. Support device 9 contains a guide rod 11 which protrudes through a corresponding hole 10 in contact plate 8 and which is fastened at its one end to a corresponding one of superconductor section 6 via, for example, a disc-shaped connecting element 12. Support device 9 is secured against sliding out of hole 10 at its opposite end by a stop 13. A spring 14 is interposed between contact plate 8 and connecting element 12. The spring is arranged to surround a respective guide rod 11 and is therefore clamped with a predetermined spring force.

If contacts 2 and 3 are joined together with the predetermined actuating force F to close the continuous-current switch according to the invention, a predetermined contact force K is produced at individual crossing 7 of each of the superconductor sections 5 with superconductor sections 6; force K being substantially identical for each contact point 7 between superconductor sections 5 and 6 as a result of the pressure forces caused by the individual springs. In this manner, the contact resistance at each contact point is correspondingly low and equal. Thus, it is possible to supply with a relatively small actuating force F, the high contact pressure required for the contacts so that the required low contact resistance between the contacts in the order of $10^{-9}$ ohm can be achieved. A correspondingly small total resistance of the continuous-current switch can be achieved by connecting many contact points in parallel. Moreover, the current-carrying capacity of the entire continuous-current switch can be determined by the number of contact points.

Superconducting conductor sections 5 and 6 may be arranged directly in a cryogenic medium which ensures its superconductivity and is, in particular, the cooling medium of the connected superconducting magnet winding. Optionally, however, indirect cooling of these conductor sections is also possible, as described in U.S. Pat. No. 4,021,633.

The relatively small actuating force F of the continuous-current switch makes possible not only the actuation assumed in FIG. 1 by means of a linkage, but also pneumatic or hydraulic operation. Such actuation is known from German Pat. No. 23 24 371. An applicable embodiment example is indicated in FIG. 2, in cross-section.

Figure 2:
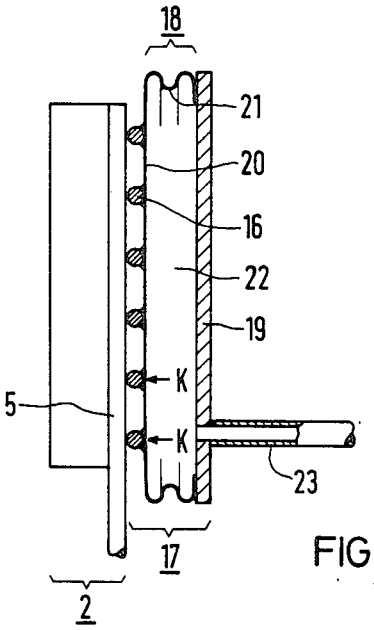
FIG. 2 is a cross-sectional representation of an embodiment which utilizes a bellows as a resilient device.

In FIG. 2, it is assumed that one of the contacts is stationary and corresponds to contact 2 with superconductor sections 5, as discussed hereinabove with respect to FIG. 1. A multiplicity of superconducting conductor sections 16 of a further contact of this switch, designated as 17, is mechanically connected via a pneumatic or hydraulic support device 18 to a stationary plate-shaped support element 19. Support device 18 contains a thin plane diaphragm which consists, for example, of alloy steel, into which the superconductor segments are rigidly fastened according to the arrangement of FIG. 1. Diaphragm 20 is fastened to the stationary support element 19 via bellows 21. The interior 22 enclosed by support element 19, spring bellows 21, and diaphragm 20 holding the superconductor sections 18 in a vacuum type manner can be acted upon by pressure via a pressure line 23 so that superconductor sections 16 are pressed with about the same contact pressure K against the superconductor sections 5 of contact 2 arranged transversely thereto. Gaseous or liquid helium can be provided as the pressure medium. With such a pneumatic or hydraulic actuation, one can advantageously dispense with linkages and corresponding feedthroughs which lead to heat inflow losses to the superconductor sections. In addition, there is the possibility of encapsulating the switch in a simple manner, illustratively in a helium atmosphere or in a vacuum, thereby preventing oxidation and long-term changes of the contact resistance.

In accordance with a particularly advantageous aspect of the invention, the continuous-current switch can be provided for magnet windings which are wound with superconducting conductor cables from several superconducting individual conductors. In this type of conductor, the superconducting individual conductors can form the superconductor sections of the contacts directly from the fanned-out conductor cable.

In the embodiments described herein, it has been assumed that the continuous-current switch of the invention has only two plane contacts with conductor sections to be joined together, the conductor sections being sprung in a plane over each crossing or contact point. However, the continuous-current switch may equally well comprise more than two planes with conductor sections, such that a resilient support of the conductor sections is provided for every second plane.

Although the invention has been disclosed in terms of specific embodiments and applications, persons skilled in the art, in light of this teaching, can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. A superconducting persistent-current switch for shorting the ends of at least one superconducting magnet winding, the switch having at least first and second contacts and comprising:

first and second support elements firmly affixed to respective ones of the first and second contacts;

a plurality of at least five superconducting conductor sections associated with the first and second support elements and arranged parallel to one another and cooled by a cryogenic coolant, the superconducting conductor sections being arranged on mutually facing surfaces of said support elements in substantially parallel planes in such a manner that the conductor sections of one of the contacts cross the conductor sections of the other contact, forming a plurality of crosspoints between the superconducting conductor sections of the first contact and the superconducting conductor sections of the second contact;

affixing means associated with said plurality of superconducting conductor sections of the first contact for affixing the first support element to said associated plurality of superconducting conductor sections;

resilient support means interposed between said plurality of superconducting conductor sections associated with the second contact and said associated second support element for resiliently coupling said second support element to said associated plurality of superconducting conductor sections; and actuating means for moving the contacts together with a predetermined contact pressure provided to the crosspoints.

2. The switch of claim 1 wherein said resilient support means further comprises:

a guiding and holding linkage connected to said second support element of the second contact; and spring means coupled with said guiding and holding linkage for resiliently urging said associated superconducting conductor sections with respect to said second support element.

3. The switch of claim 1 wherein said superconducting conductor sections of said contacts are arranged in a vacuum space.

4. The switch of claim 1 wherein said superconducting conductor sections are formed of unstabilized superconductive material.

5. The switch of claim 1 wherein said superconducting conductor sections are formed of stabilized conductors.

6. The switch of claim 5 wherein said superconducting conductor sections contain superconductive material at least on corresponding contact surface portions.

7. The switch of claim 1 wherein said resilient support means comprises:

a spring bellows connected to said second support element of the second contact, the interior of said spring bellows being enclosed by said second support element; and a diaphragm to which are affixed said associated superconducting conductor sections, whereby said spring bellows and said diaphragm are set to a predetermined pressure of a gaseous or liquid coolant.

8. The switch of claim 7 wherein said diaphragm has a thin thickness and is made of alloy steel.

9. The switch of claim 7 wherein said coolant for cooling the superconducting magnet winding serves as a pressure medium for said spring bellows means.

* * * * *